US008435709B2

(12) United States Patent
Yamamoto et al.

(10) Patent No.: US 8,435,709 B2
(45) Date of Patent: May 7, 2013

(54) TONER FOR DEVELOPING LATENT ELECTROSTATIC IMAGE, PROCESS CARTRIDGE AND IMAGE FORMING METHOD

(75) Inventors: Atsushi Yamamoto, Kawanishi (JP); Chiyoshi Nozaki, Otsu (JP); Tsuyoshi Nozaki, Ikeda (JP); Takuya Kadota, Kobe (JP); Hiroyuki Murakami, Toyonaka (JP); Mitsuyo Matsumoto, Ibaraki (JP); Katsunori Kurose, Takarazuka (JP); Yoshimichi Ishikawa, Itami (JP)

(73) Assignee: Ricoh Company, Ltd., Tokyo (JP)

( * ) Notice: Subject to any disclaimer, the term of this patent is extended or adjusted under 35 U.S.C. 154(b) by 971 days.

(21) Appl. No.: 12/049,719

(22) Filed: Mar. 17, 2008

(65) Prior Publication Data

US 2008/0233497 A1 Sep. 25, 2008

(30) Foreign Application Priority Data

Mar. 19, 2007 (JP) ..... 2007-069748
Nov. 16, 2007 (JP) ..... 2007-297600

(51) Int. Cl.
*G03G 9/087* (2006.01)

(52) U.S. Cl.
USPC ..... 430/108.24; 430/108.6; 430/108.7; 430/109.3

(58) Field of Classification Search ..... 430/108.7, 430/108.24, 108.1, 109.3, 108.6
See application file for complete search history.

(56) References Cited

U.S. PATENT DOCUMENTS 6,635,398 B1 * 10/2003 Komoto et al. ..... 430/108.23
6,782,219 B2 * 8/2004 Yoshino et al. ..... 399/90
7,309,558 B1 * 12/2007 Michel et al. ..... 430/137.1
2005/0277040 A1 12/2005 Michel et al.
2006/0020069 A1 1/2006 Michel et al.
2006/0204882 A1 9/2006 Nozaki et al.
2006/0210902 A1 9/2006 Nakamura et al.
2006/0275686 A1 12/2006 Kadota et al.
2007/0026335 A1 2/2007 Yamamoto et al.
2007/0059625 A1 3/2007 Yamamoto et al.
2007/0166635 A1 7/2007 Yamamoto et al.
2007/0190442 A1 8/2007 Nakamura et al.
2007/0207399 A1 9/2007 Kadota et al.
2007/0212630 A1 9/2007 Yasunaga et al.
2007/0217842 A1 9/2007 Kato et al.
2007/0218380 A1 * 9/2007 Uchinokura et al. ..... 430/108.1
2007/0218384 A1 9/2007 Matsumoto et al.
2007/0218388 A1 9/2007 Kurose et al.
2007/0218393 A1 9/2007 Nozaki et al.
2007/0238042 A1 10/2007 Yasunaga et al.
2008/0038656 A1 2/2008 Yasunaga et al.
2008/0102049 A1 * 5/2008 McDermott ..... 424/64
2008/0227013 A1 9/2008 Kadota et al.

FOREIGN PATENT DOCUMENTS

JP 2-111967 4/1990
JP 2001-242755 9/2001
JP 2002-72544 3/2002
JP 2003-515795 5/2003
JP 2003-202708 7/2003
JP 2005-49853 2/2005
JP 2005-49858 2/2005
JP 2005-257976 9/2005
JP 2006-500605 1/2006
JP 2006-503313 1/2006
JP 2006-47743 2/2006
JP 2006-293311 10/2006
JP 2007-34280 2/2007

OTHER PUBLICATIONS

USPTO Trademark Electronic Search System (TESS) file for trademark TIXOGEL, Serial No. 73328003, registration date Aug. 23, 1983, printed on May 4, 2012.*
Claytone APA Material Safety Data Sheet, Southern Clay Products (Oct. 2008).*
Claytone AF Material Safety Data Sheet, Southern Clay Products (Jan. 2009).*
Office Action issued Sep. 5, 2011 in Japan Application No. 2007-297600.

* cited by examiner

*Primary Examiner* — Janis L Dote
(74) *Attorney, Agent, or Firm* — Oblon, Spivak, McClelland, Maier & Neustadt, L.L.P.

(57) ABSTRACT

A toner for developing a latent electrostatic image produced by suspension polymerizing a polymerizable monomer composition in an aqueous dispersion medium, wherein the polymerizable monomer composition contains a polymerizable monomer, a colorant, and a layered inorganic mineral in which at least a part of an interlayer ion is replaced with an organic ion, and a process cartridge and an image forming method using the toner.

7 Claims, 1 Drawing Sheet

TONER FOR DEVELOPING LATENT ELECTROSTATIC IMAGE, PROCESS CARTRIDGE AND IMAGE FORMING METHOD

BACKGROUND OF THE INVENTION

1. Field of the Invention

The present invention relates to a toner for developing a latent electrostatic image, a process cartridge and an image forming method.

2. Description of the Related Art

A developer used in electrophotography, electrostatic recording or electrostatic printing is, for example, once adhered to an image bearing member such as a photoconductor on which an electrostatic image is formed in a developing step, and transferred from the photoconductor to a transfer medium such as a transfer paper in a transferring step, and then fixed on the paper in a fixing step. As a developer to develop an electrostatic image formed on a surface of the latent electrostatic image bearing member, a two component developer containing a carrier and toner, and a one component developer containing a toner without carrier (a magnetic toner or non magnetic toner) have been known.

Conventionally, as a dry toner used in electrophotography, electrostatic recording or electrostatic printing, a toner, in which a toner binder such as a styrene resin or polyester is melted and kneaded with a colorant and pulverized, is used.

To obtain a high-grade and high-quality image in electrophotography, electrostatic recording or electrostatic printing, toners have been improved by reducing their particle diameters and narrowing their particle size distributions. However, a toner may have a indeterminate particle shape when produced using common kneading and pulverizing method, and in a machine, the toner is further pulverized by stirring with a carrier in a developing part, and by contacting with a developing roller, a toner supplying roller, a layer thickness regulation blade and a frictional electrification blade when the toner is used as a one component developer, and then submicron particles may be generated and a fluidizing agent is embedded in a toner surface, thereby reducing image quality. The toner has a poor fluidity as a powder because of its shape, and needs a large amount of a fluidizing agent, and has a poor filling rate in a toner bottle. This blocks downsizing of an image forming apparatus.

A transferring process of a formed image, which is composed of a multi-color toner to produce a full color image, from a photoconductor to a transfer medium or a paper has been becoming complicated. An indeterminate particle shape, such as that of a pulverized toner adversely affects transferring property, a transferred image may have a missing part and the large amount of toner is consumed to make up for the missing part.

Therefore, there has been an increasing demand for obtaining a high-grade image without a missing part with less amount of toner consumption by improvement of transferring efficiency, and for reduction of a running cost. The toner having an excellent transferring property does not need a cleaning unit to remove untransferred toner particles from a photoconductor and transfer medium, and achieves advantages, for example, an a downsized apparatus, low cost and no waste toner. In order to make up for disadvantages of the indeterminate particle shape, various methods for producing spherical toners have been invented.

For example, in addition to a suspension polymerization method, an emulsion polymerization method and dissolving suspension method in which particles are relatively-easily deformed have been proposed (See Japanese Patent Application Laid-Open (JP-A) Nos. 2-111967 and 2003-202708).

A mixture containing a toner raw material such as a binder resin or a monomer from which the binder resin is made, a colorant, a wax component and a charge control agent is dispersed in an aqueous medium to granulate particles of the mixture of the toner raw material, thereby obtaining toner particles having suitable size, specifically, having a diameter of approximately 3 μm to 12 μm. The obtained toner particles are taken out of the aqueous dispersion medium, washed, and dried to yield a toner.

However, in suspension polymerization, radical polymerization is generally performed and useful monomers are limited to carboxylic acids and esters thereof having a radical polymerizable unsaturated double bond, such as styrene, acrylic acid and methacrylic acid, in terms of cost. The styrene-acrylic resin to be polymerized can be designed to have suitable electrostatic property and fixing property, but not strong enough as a resin, and a toner may be broken and cracked by contact stress in a developing process. Toner fine powders generated by toner crack remain on a developing roller because they have large electrostatic or non-electrostatic adhesive force. The developing roller contaminated by the toner fine powders has less toner charging ability. As a result, toners are printed in a white part, so-called background smear occurs. When toner is cracked, the low melting point wax component inside the toner is exposed and when the toner having exposed wax passes a regulation blade, the toner adheres to the regulation blade, leading to accumulation of toner and external additive on the regulation blade, namely, so-called toner fixation occurs. When the toner fixes on the regulation blade, streaks where toners are not transferred on a developing roller occur, and white lines are generated in a part to be printed in a printed image.

As a method for increasing the rigidity of the resin, it is known that a small amount of polyfunctional monomers such as divinylbenzene and diacrylate compound is added so that the resin has a crosslinked structure and the crosslinked structures are uniformly formed in the toner. When the toner has many crosslinked points, the toner do not easily melt and not fix well. When the toner has a little crosslinked points, crosslinking is not effective. Thus, it is extremely difficult to design a toner having an appropriate crosslinked structure.

In terms of toner shape, a toner having an uneven shape easily causes a problem of the contamination of a photoconductor during process caused by silica added as a fluidizing agent having a weak adhesion force in a depression part, and silica migration to the depression part. In a dissolution-suspension method, a polyester resin capable of fixing at low temperature can be used, but a polymeric component may be necessarily added, and then liquid viscosity is increased and problems occur in productivity. An irregular uneven shape lacks charge stability, and moreover problems remain in durability and releasability.

To control electrostatic property of a toner, a charge control agent is added, but filming and a problem in fixing property occur. It has been proposed that when a toner is produced, a swellable clay substance is mixed and added so as to obtain a non-spherical toner, thereby improving cleaning property. A layered inorganic mineral is generally attracted as a charge control agent for a toner.

The layered inorganic mineral is an inorganic mineral having a microscopic structure in which layers of inorganic molecules are laminated and aggregated. A layer of inorganic molecule has a thickness of several Å to several nm, several hundred nm to several μm, and a configuration of one or a several laminated layers of a tetrahedral sheet in which tetrahedron having Si, Al and Fe in the center two dimensionally spreads, or a octahedral sheet in which octahedron having Al and Mg in the center two dimensionally spreads.

Examples of the layered inorganic minerals having only an octahedral sheet include brucite and hydrotalcite. Examples of the layered inorganic minerals having a 1:1 structure in which a tetrahedral sheet and an octahedral sheet are layered, include kaolin, serpentine and halloysite. Examples of the layered inorganic minerals having a 2:1 structure in which two tetrahedral sheets form on either side of an octahedral sheet include, talc, pyrophyllite, saponite, hectorite, montmorillonite, beidellite, vermiculite, natural mica, synthetic mica, lepidolite, illite, paragonite, clintonite, margarite, clinochlore, chamosite, nimite, donbassite, cookeite and sudoite.

An inorganic molecule layer may have positive or negative charge, depending on valence of metal atom constituting each layer. Anions and cations are intercalated in the interlayers and charges are canceled in total. In natural products, carbonate ions, inorganic ions such as $Cl^-$, $Na^+$, $K^+$, $Mg^{2+}$, $Ca^{2+}$ are intercalated and have high hydrophilicity. Examples of the layers having positive charge (anionic layered inorganic minerals) include hydrotalcite, and examples of the layers having negative charge (cationic layered inorganic minerals) include saponite, hectorite, montmorillonite, beidellite, vermiculite, natural mica, synthetic mica, lepidolite, illite, paragonite, clintonite, margarite, clinochlore, chamosite, nimite, donbassite, cookeite and sudoite. As a result, between the laminated inorganic molecule layers, force having a charge such as an electrostatic force works in addition to van der Waals force. Hydrotalcite, hectorite, montmorillonite, beidellite, vermiculite and swellable mica have relatively weak electrostatic force, and some of them may be swelled by taking water molecules into interlayer, and finally the laminated structure thereof may be separated.

Moreover, in the layered inorganic mineral, an intercalated inorganic ion can be relatively easily exchanged with other ions, and can be exchanged with a lipophilic carboxylic acid and sulfonic acid such as alkyl carboxylic acid; ammonium cation and imidazolium cation. The inorganic mineral, in which an interlayer ion is replaced with a lipophilic ion is called as an organically modified inorganic mineral (Japanese Patent Application Laid-Open (JP-A) Nos. 2003-202708, 2006-500605 and 2006-503313).

When the layered inorganic mineral is added to a toner, a non-organically modified layered inorganic mineral has poor compatibility with a resin, and is detached from the toner. However, the layered inorganic mineral is organically modified to have higher oil solubility to be dispersed into the toner, thereby improving charge control property and heat stability.

BRIEF SUMMARY OF THE INVENTION

An object of the present invention is to provide a toner having excellent fixing property, and capable of resisting stress caused by being mixed with carrier and a regulation blade in an electrophotographic process, and having sufficient charge amount.

As a result of keen examination, it has been achieved that in a suspension polymerization toner, a layered inorganic mineral, in which at least interlayer ions partly modified with an organic ion (hereinafter referred to as "organically modified layered inorganic mineral") is dispersed, is contained so as to be localized near a toner surface, and thus, the toner rigidity can be increased and additionally the resin impregnates well into a paper because a resin structure inside the toner is not essentially changed, thereby yielding the toner having excellent fixing property.

The above-mentioned problems are solved by the following <1> to <23>.

<1> A toner for developing a latent electrostatic image produced by suspension polymerizing a polymerizable monomer composition in an aqueous dispersion medium, wherein the polymerizable monomer composition contains a polymerizable monomer, a colorant, and a layered inorganic mineral in which at least a part of an interlayer ion is replaced with an organic ion.

<2> The toner for developing a latent electrostatic image according to <1>, wherein the layered inorganic mineral is localized near a toner surface.

<3> The toner for developing a latent electrostatic image according to any one of <1> to <2>, wherein the amount of the layered inorganic mineral is 0.05 mass % to 5 mass % in the toner.

<4> The toner for developing a latent electrostatic image according to any one of <1> to <3>, wherein the toner has a glass transition temperature of 40° C. to 70° C.

<5> The toner for developing a latent electrostatic image according to any one of <1> to <4>, wherein a resin is dissolved in the polymerizable monomer composition.

<6> The toner for developing a latent electrostatic image according to any one of <1> to <5>, wherein after the polymerizable monomer is partly polymerized, the layered inorganic mineral is dispersed in the polymerizable monomer composition.

<7> A process cartridge containing a developing unit at least which contains a toner carrying unit configured to carry a toner for developing a latent electrostatic image by its rotation, and a toner feeding unit configured to feed the toner to the toner carrying unit, wherein the toner for developing a latent electrostatic image is produced by suspension polymerizing a polymerizable monomer composition in an aqueous dispersion medium, wherein the polymerizable monomer composition contains a polymerizable monomer, a colorant, and a layered inorganic mineral in which at least a part of an interlayer ion is replaced with an organic ion.

<8> The process cartridge according to <7>, wherein the layered inorganic mineral is localized near a toner surface.

<9> The process cartridge according to any one of <7> to <8>, wherein the amount of the layered inorganic mineral is 0.05 mass % to 5 mass % in the toner.

<10> The process cartridge according to any one of <7> to <9>, wherein the toner has a glass transition temperature of 40° C. to 70° C.

<11> The process cartridge according to any one of <7> to <10>, wherein a resin is dissolved in the polymerizable monomer composition.

<12> The process cartridge according to any one of <7> to <11>, wherein after the polymerizable monomer is partly polymerized, the layered inorganic mineral is dispersed in the polymerizable monomer composition.

<13> An image forming method containing charging an untransferred toner for developing a latent electrostatic image adhering to a surface of a latent electrostatic image bearing member by a toner charging unit, before charging a surface of the latent electrostatic image bearing member, and collecting the charged toner in a developing unit, wherein the toner for developing a latent electrostatic image produced by suspension polymerizing a polymerizable monomer composition in an aqueous dispersion medium, wherein the polymerizable monomer composition contains a polymerizable monomer, a colorant, and a layered inorganic mineral in which at least a part of an interlayer ion is replaced with an organic ion.

<14> The image forming method according to <13>, wherein the layered inorganic mineral is localized near a toner surface.

<15> The image forming method according to any one of <13> to <14>, wherein the amount of the layered inorganic mineral is 0.05 mass % to 5 mass % in the toner.

<16> The image forming method according to any one of <13> to <15>, wherein the toner has a glass transition temperature of 40° C. to 70° C.

<17> The image forming method according to any one of <13> to <16>, wherein a resin is dissolved in the polymerizable monomer composition.

<18> The image forming method according to any one of <13> to <17>, wherein after the polymerizable monomer is partly polymerized, the layered inorganic mineral is dispersed in the polymerizable monomer composition.

<19> The image forming method according to any one of <13> to <18>, wherein the toner charging unit is a conductive sheet pressed onto a surface of the latent electrostatic image bearing member.

<20> The image forming method according to any one of <15> to <19>, wherein the conductive sheet is made of any one selected from nylon, PTFE, PVDF, and urethane.

<21> The image forming method according to any one of <19> to <20>, wherein the conductive sheet has a thickness of 0.05 mm to 0.5 mm.

<22> The image forming method according to any one of <19> to <21>, wherein the conductive sheet has a volume resistivity of $10e^{+1}\Omega$ to $10e^{+9}\Omega$.

<23> The image forming method according t to any one of <19> to <22>, wherein the conductive sheet is applied with a voltage of −1.4 kV to 0 kV.

The present invention provides a toner obtained by suspension polymerizing a polymerizable monomer composition containing a modified layered inorganic mineral in an aqueous dispersion medium, having excellent fixing property, capable of resisting stress by mixing carriers and a regulation blade in an electrophotographic process, and having sufficient charge amount, and an image excellent in transferring property and fixing property, can be formed by using the toner.

DETAILED DESCRIPTION OF THE INVENTION

Figure 1:
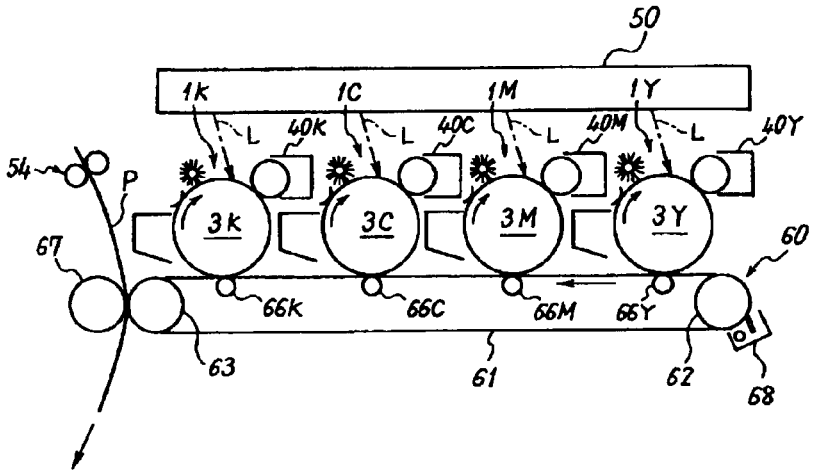
FIG. 1 shows a schematic structural view of the main part of a printer relating to an embodiment.

According to the present invention, it was found that in a toner obtained by suspension polymerizing oil droplets in which a pigment and wax are dispersed into a polymerizable monomer in water, so-called a suspension polymerization toner, when an organically modified layered inorganic mineral is dispersed into the polymerizable monomer composition, the organically modified layered inorganic mineral is localized near the toner surface, thereby increasing rigidity near the toner surface.

The layered inorganic mineral may be often used to give rigidity and gas barrier property to a plastic. Consequently, the layered inorganic mineral is dispersed in a toner to increase the toner rigidity, thus the crack and deformation of the toner by various stresses in an electrophotographic process may be prevented.

However, in a toner obtained by a suspension polymerization method, the layered inorganic mineral is dispersed along with a pigment and wax for polymerization, and then a layered inorganic compound is transferred to an aqueous phase in a granulation step, and the layered inorganic compound cannot be kept inside the toner or is exposed on the toner surface. The electrostatic property of the toner is decreased under high temperature and high humidity atmosphere, and background smear occurs in a white part. It is considered that the layered inorganic compound transfers to an aqueous phase because a system becomes stable by dispersing the layered inorganic compound containing the layered inorganic mineral having high polarity in the aqueous phase, and that the toner is not charged under high temperature and high humidity atmosphere because the layered inorganic mineral having high polarity easily contains water molecules in an atmosphere into a surface and interlayer of the layered inorganic mineral.

Consequently, an organically modified layered inorganic mineral, in which the layered inorganic compound is modified with an organic ion having a hydrophobic group, is used to be easily mixed in an organic substance such as a resin, and the inherent polarity of the layered inorganic mineral is moderately reduced by organic modification. Therefore, the organically modified layered inorganic mineral is not exposed on, but localized near the toner surface.

As a result, rigidity near the toner surface is increased, and crack and deformation by mechanical stress can be suppressed in an electrophotographic process, and a melted toner shows the same behavior as a toner not containing the organically modified layered inorganic mineral, because the composition inside the toner has not been changed. Therefore, there is no influence on impregnating ability to a paper when fixing the toner.

Moreover, the toner containing the layered inorganic mineral localized near the toner surface is highly charged by frictional electrification. This may be originated from localization of the layered inorganic mineral inherent charges. Additionally, the layered inorganic mineral localized near the toner surface, allowing to exert its effect very efficiently.

Furthermore, the quality of the toner containing the layered inorganic mineral, which is not exposed on the toner surface, is hardly degraded, even though the toner is stored for a long time. This is because the layered inorganic mineral is localized near the toner surface so as to uniformly cover the toner surface, and oxygen penetration into the toner is prevented and oxidation of a resin and pigment molecule is not progressed.

The organically modified layered inorganic mineral localized near the toner surface is such a state that the layered inorganic mineral is originally hydrophobic but has adequate hydrophilic property by partly modifying metal ions contained in the layered inorganic mineral with an organic ion, and thus the organically modified layered inorganic mineral easily orients to an aqueous phase in an oil droplet under dispersion and emulsification, that is, the layered inorganic mineral is present close to the surface in a droplet. Therefore, the present invention requires less amount of toner to obtain comparable chargeability with a pulverization toner, and fixing property is improved.

In the present invention, a method for modifying the layered inorganic mineral is exemplified as follows:

A cationic layered inorganic mineral can be modified with an organic cation, and an anionic layered inorganic mineral can be modified with an organic anion.

Examples of organic cations include quaternary alkyl ammonium salts, phosphonium salts and imidazolium salts. Of these, quaternary alkyl ammonium salts are preferred. Examples of quaternary alkyl ammonium includes trimethylstearyl ammonium, dimethylstearylbenzyl ammonium, dimethyloctadecyl ammonium and oleylbis(2-hydroxyethyl) methyl ammonium.

Examples of organic anions include sulfate salts, sulfonate salts, carboxylate salts and phosphate salts having branched, non-branched or cyclic alkyl (C1 to C44), alkynyl (C1 to C22), alkoxy (C8 to C32), hydroxyalkyl (C2 to C22), ethylene oxide and propylene oxide. Specific examples of organic anions include sodium dodecylbenzenesulfonate, sodium lauryl sulfate, lauric acid, oleic acid, stearic acid and behenic acid.

Examples of commercially available products of the layered inorganic mineral partly modified with an organic cation include quaternium 18 bentonite such as BENTONE 3, BENTONE 38, BENTONE 38V (from Rheox), TIXOGEL VP (from United Catalyst), CLAYTONE 34, CLAYTONE 40, CLAYTONE XL (from Southern Clay); stearalkonium bentonite such as BENTONE 27 (from Rheox), and TIXOGEL LG (from United Catalyst), bis(hydrogenated tallow alkyl) dimethyl quaternary ammonium salts with bentonite such as CLAYTONE AF, benzyl(hydrogenated tallow alkyl)dimethyl quaternary ammonium salt of bentonite such as CLAYTONE APA (from Southern Clay); and quaternium 18/benzalkonium bentonite such as CLAYTONE HT and CLAYTONE PS (from Southern Clay). Of these, CLAYTONE AF and CLAYTONE APA are particularly preferable.

The layered inorganic mineral partly modified with an organic anion may be appropriately selected. Examples thereof include anionic layered inorganic minerals such as commercially available hydrotalcites with the above-described organic anions. Examples of commecially available products of hydrotalcites include DHT-4A (by Kyowa Chemical Industry Co., Ltd.), Pural MG 61, Pural MG 70 (by Sasol), Syntal HSAC 701 and Syntal HAS 696 (by Sudchemie).

The layered inorganic mineral used in the present invention is localized near the toner surface, thus the effect of the present invention can be exhibited by a relatively small amount of the layered inorganic mineral in the toner. Specifically, the amount of the layered inorganic mineral is preferably 0.05 mass % to 5 mass %, preferably 0.1 mass % to 3 mass %, and more preferably 0.2 mass % to 2 mass %, relative to the toner in total. When the amount of the layered inorganic mineral is less than 0.05 mass %, the effect of the present invention is hardly exhibited, and sufficient rigidity may not be imparted to the toner. When the amount of the layered inorganic mineral is more than 5 mass %, dispersion of the layered inorganic mineral spreads inside the toner, the toner becomes hard to be deformed when fixing, and the fixing property of the toner may be decreased.

As a polymerizable monomer used in the toner of the present invention vinyl polymerizable monomers capable of undergoing radical polymerization may be used. Examples of the vinyl polymerizable monomers include monofunctional polymerizable monomers and polyfunctional polymerizable monomers.

Examples of monofunctional polymerizable monomers include styrene or styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylate polymerizable monomer such as methylacrylate, ethylacrylate, n-propylacrylate, isopropyl acrylate, n-butyl acrylate, isobutyl acrylate, t-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxy ethyl acrylate; methacrylate polymerizable monomers such as methyl methacrylate, ethyl methacrylate, n-propyl methacrylate, isopropyl methacrylate, n-butyl methacrylate, isobutyl methacrylate, t-butyl methacrylate, n-amylmethacrylate, n-hexylmethacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy-diethoxy) phenyl)propane, trimethylolpropane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxy-diethoxy)phenyl)propane, 2,2'-bis(4-(methacryloxy-polyethoxy)phenyl)propane, trimethylolpropane trimethacrylate, tetramethylolmethane tetramethacrylate, divinylbenzene, divinylnaphthalene and divinylether.

In the present invention, the above-described monofunctional polymerizable monomer is used alone or in combination of two or more, or the above-described monofunctional polymerizable monomer is used in combination with polyfunctional polymerizable monomer. Of the above-described monomers, styrene or the derivative thereof is preferably used alone or in combination, or by mixing with other monomers, in terms of developing property and durability of the toner.

Examples of wax used in the invention include petroleum wax such as paraffin wax, microcrystalline wax and petrolactam, and derivatives thereof; montan wax and derivatives thereof; hydrocarbon wax obtained by a Fischer-Tropsch method and derivatives thereof; polyolefin waxes such as polyethylene and derivatives thereof; and natural waxes such as carnauba wax, and candelilla wax and derivatives thereof. Examples of the derivatives include oxides, block copolymers with vinyl monomers, and graft modified products. Examples of the waxes further include alcohols such as higher aliphatic alcohol; fatty acids such as stearic acid and palmitic acid, and compounds thereof; acid amides, esters, ketones, hardening castor oil, and derivatives thereof; plant wax; and animal wax. These may be used alone or in combination of two or more.

As a wax component used in the present invention, a compound having a main endothermic peak temperature (a melting point) in a DSC curve measured according to "ASTM D3418-82" in a range of 30° C. to 120° C. and preferably 40° C. to 90° C. in order to improve fixing property and transparency.

A polymerization initiator may be used to start suspension polymerization as necessary. Specifically, so-called oil soluble polymerization initiator, which uniformly dissolves in a polymerizable monomer, may be used. Examples thereof include azo or diazo polymerization initiators such as 2,2'-azobis (2,4-dimethylvaleronitrile), 2,2'-azobisisobutylonitrile, 1,1'-azobis (cyclohexane-1-carbonitrile), 2,2'-azobis-4-methoxy-2,4-dimethylvaleronitrile, azobisisobutylonitrile; peroxide-based polymerization initiators such as benzoyl peroxide, methyl ethyl ketone peroxide, diisopropyl peroxycarbonate, cumenehydroperoxide, 2,4-dichlorobenzoylperoxide and lauroyl peroxide. The amount of the polymerization initiator to be used may vary depending on a desired degree of polymerization, and generally 5 parts by mass to 20 parts by mass relative to 100 parts by mass of a polymerizable vinyl monomer. The kinds of the polymerization initiators may somewhat differ depending on a polymerization method, and may be used alone or mixed with reference to 10-hour half-life temperature.

When the toner of the present invention is produced by a suspension polymerization method, known organic dispersants and inorganic dispersants may be used as dispersants for preparing an aqueous dispersion medium. Examples of inorganic dispersants include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. Examples of organic dispersants include polyvinyl alcohol, gelatin, methylcellulose, methyl hydroxypropylcellulose, ethyl cellulose, sodium salts of carboxymethylcellulose and starch.

Moreover, commercially available nonionic, anionic and cationic surfactant may be used. Examples thereof include sodium dodecyl sulfate, sodium tetradecyl sulfate, sodium pentadecyl sulfate, sodium octyl sulfate, sodium oleate, sodium laurate, potassium stearate and calcium oleate.

When the toner of the present invention is produced by a suspension polymerization method, a poor water-soluble inorganic dispersant is preferably used, furthermore a poor water-soluble and acid-soluble one is advantageously used as a dispersant for preparing an aqueous dispersion medium. In the invention when the aqueous dispersion medium is prepared by using the poor water-soluble inorganic dispersant, 0.2 parts by mass to 2.0 parts by mass of the dispersant is preferably used relative to 100 parts by mass of a polymerizable vinyl monomer. In the invention, the aqueous dispersion medium is preferably prepared by using 300 parts by mass to 3,000 parts by mass of water relative to 100 parts by mass of a polymerizable monomer composition.

In the present invention, when the aqueous dispersion medium in which the poor water-soluble inorganic dispersant is dispersed is prepared, commercially available dispersants may be directly dispersed therein. However, in order to obtain dispersion particles having a uniform and fine particle size, the poor water-soluble inorganic dispersant may be generated and prepared in a liquid medium such as water under high speed stirring. For example, when tricalcium phosphate is used as a dispersant, an aqueous solution of sodium phosphate and an aqueous solution of calcium chloride are mixed under high speed stirring so as to form tricalcium phosphate fine particles, thereby obtaining a preferable dispersant.

The toner of the present invention preferably has a glass transition temperature of 40° C. to 70° C. When the glass transition temperature is less than 40° C., heat-resistant storage property may be poor. When the glass transition temperature is more than 70° C., fixing property may be poor.

In the present invention, a glass transition point (Tg) is measured on Rigaku THERMOFLEX TG 8110 by Rigaku Corporation in the condition of a temperature rise rate of 10° C./min. A method of measuring Tg will be generally explained. As an apparatus of measuring Tg, TG-DSC system TAS-100 by Rigaku Corporation is used.

To start with, about 10 mg of a sample is put in a sample container made of aluminum and the sample container is mounted on a holder unit. The holder unit is set in an electric furnace. The sample is heated by raising a temperature from room temperature to 150° C. at a temperature rise rate of 10° C./min and left to stand at 150° C. for 10 minutes. Then the sample is cooled down to room temperature and left to stand for 10 minutes. The sample is heated up to 150° C. in a nitrogen atmosphere at a temperature rise rate of 10° C./min, and then a DSC measurement is carried out. The glass transition point Tg is calculated from a contact point of a tangent of an endothermic curve near the glass transition point Tg and a base line, by using an analysis system in TAS-100 system.

As a method of obtaining the toner the present invention, a suspension polymerization method is used, in which a polymerizable monomer composition which contains at least a polymerizable monomer, colorant and organically modified layered inorganic mineral is suspension-polymerized in an aqueous dispersion.

In the present invention, the organically modified layered inorganic mineral is preferably localized near the toner surface. Thus, it is necessary that the layered inorganic mineral is sufficiently dispersed in the polymerizable monomer composition in the process of producing the toner.

To sufficiently disperse the layered inorganic mineral of the present invention, it is necessary to sufficiently put shear force on the polymerizable monomer composition in a step of dispersing a polymerizable monomer composition. Thus, the polymerizable monomer composition preferably has a certain degree of viscosity. Methods for increasing the viscosity of the polymerizable monomer composition include, for example, dissolving a resin preliminarily in a polymerizable monomer composition, partly polymerizing a polymerizable monomer, and the like.

As a resin dissolved in the polymerizable monomer composition, any resin may be used as long as the resin dissolves in a polymerizable monomer. Examples of the resins include polyester resins, epoxy resins, styrene-acrylic acid copolymers, styrene-methacrylic acid copolymers and styrene-maleic acid copolymers. The resin preferably has a weight average molecular weight of 3,000 to 50,000 and preferably has 5,000 to 30,000. When the resin has a weight average molecular weight of less than 3,000, the viscosity of a polymerizable monomer composition cannot be controlled. When the resin has a weight average molecular weight of more than 50,000, the solubility to a polymerizable monomer may be decreased. The amount of the resin dissolved in the polymerizable monomer composition is 1 mass % to 50 mass %, preferably 2 mass % to 25 mass %, and more preferably 2 mass % to 10 mass %, relative to the polymerizable monomer, although it depends on a molecular mass of the resin. When the resin dissolved in the polymerizable monomer composition is less than 1 mass %, the viscosity of the polymerizable monomer composition is not increased. When the resin dissolved in the polymerizable monomer composition is more than 50 mass %, the viscosity of the polymerizable monomer is too high, and excessive shear energy is needed in a dispersing step. The resin dissolved in the polymerizable monomer composition preferably has a glass transition temperature of 30° C. to 85° C. When the glass transition temperature is less than 30° C., heat-resistant storage property may be adversely affected. When the glass transition temperature is more than 80° C., the fixing property may be poor.

In the dispersing step, shear force is put on the polymerizable monomer composition so as to convert a part of shear energy to heat energy. Thus, cooling should be performed as necessary. When heat is generated too high and cooling is insufficiently performed, the temperature of the polymerizable monomer composition is raised and the viscosity thereof is decreased, and shear force cannot be sufficiently put on the polymerizable monomer composition. As a result, the layered inorganic mineral of the present invention is insufficiently dispersed and the organically modified layered inorganic mineral is localized near the toner surface. Therefore, as an effect of the present invention, rigidity of the toner surface cannot be improved.

When the shear energy for dispersing the polymerizable monomer composition is too high, the layered inorganic mineral of the invention and pigment are excessively dispersed (excess dispersion), and dispersion state may be rapidly unstable. As a result, these dispersing substances aggregate, and the properties of the organically modified layered inorganic mineral may be insufficient, and the degree of coloring of the toner may be reduced. Therefore, excess dispersion is not preferred.

Dispersing machines used for dispersing the polymerizable monomer composition are not particularly limited, and preferable examples thereof include pressure dispersing machines such as an ultrasonic disperser, a mechanical homogenizer, a Manton-Gaulin homomixer, CLEAR MIX, CLEAR SS5, and a pressure homogenizer; a medium type dispersing machines such as Attriter, sand grinder, Gettsman mil and diamond fine mill. After dispersion, the polymerizable monomer composition has a viscosity of 100 cP·s to 3,000 cP·s and preferably 200 cP·s to 2,000 cP·s, for example, measured by a Brookfield type viscometer in the condition of a rotating speed of 100 rpm and a liquid temperature of 24° C.

In the present invention, the organically modified layered inorganic mineral is used. A pigment (particles) may be surface-modified. A method for surface-modifying a pigment is, for example, a method in which a pigment is dispersed in a solvent, and a surface modifier is added therein, and the system is heated to be reacted. After the reaction, the pigment is filtrated, and washing and filtration is repeated by the same solvent, and then dried to obtain a pigment treated with a surface modifier.

Hereinafter, as an image forming apparatus according to the present invention, an embodiment of an electrophotographic color laser printer (hereinafter, simply referred to as a printer) will be explained.

First, there is described the basic structure of a printer according to the present embodiment. FIG. 1 is a schematic structural view of the main part of the printer relating to the present embodiment. The printer is equipped with four process cartridges 1Y, 1M, 1C and 1K so as to form a toner image of each color: yellow, magenta, cyan, and black (hereinafter, referred to as Y, M, C and K). The printer is also equipped with an optical writing unit 50, a resist roller pair 54, a transfer unit 60, and the like. The character Y, M, C, or K after each numeral for a member means that the member is used for yellow, magenta, cyan, or black.

The optical writing unit 50, which is a unit for forming a latent electrostatic image, includes components such as a light source consisting of four laser diodes corresponding to each color of Y, M, C, and K; a polygon mirror having a regular hexahedron form; a polygon motor for rotating the mirror; a fθ lens; a lens; and a reflection mirror. A laser beam L emitted from a laser diode is reflected any one of the faces of the polygon mirror and deflected according to the rotation of the polygon mirror to reach any one of four photoconductors described later. Each of the surfaces of the four photoconductors are optically scanned with a laser beam L emitted from each of the four laser diodes.

The process cartridges 1Y, 1M, 1C and 1K respectively include components such as drum-shaped photoconductors 3Y, 3M, 3C, and 3K as latent electrostatic image bearing members; and developing devices 40Y, 40M, 40C and 40K as developing units corresponding to each of the 3Y, 3M, 3C, and 3K. The photoconductors 3Y, 3M, 3C, and 3K are rotated clockwise in the figure at a predetermined linear velocity by a driving unit (not shown). Then the optical writing unit 50 emitting laser beams L modulated based on image data transmitted from a personal computer or the like (not shown) optically scans the photoconductors in the dark, whereby the photoconductors bear latent electrostatic images for Y, M, C, and K.

Figure 2:
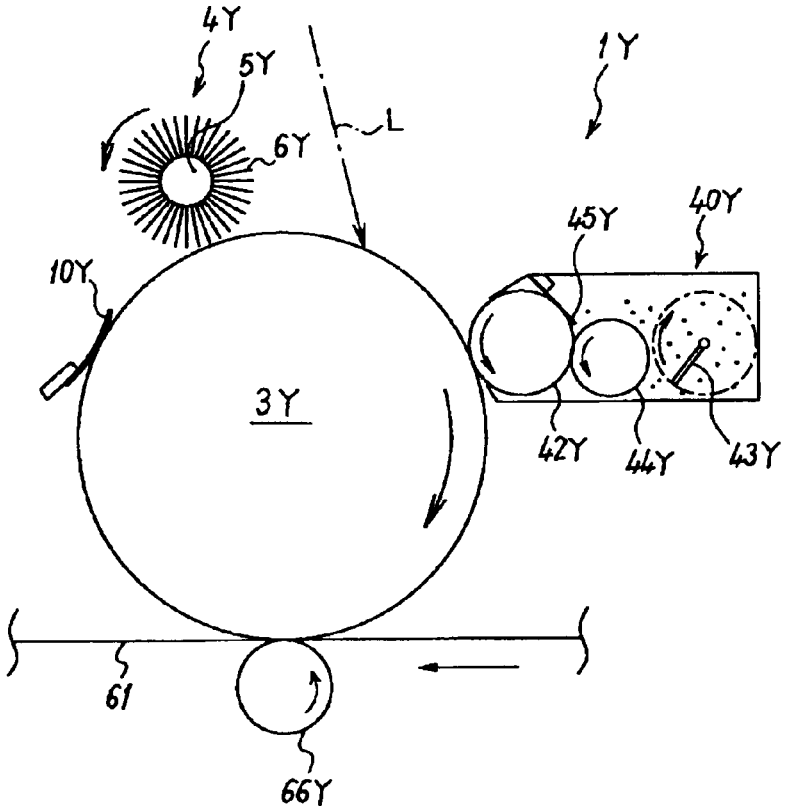
FIG. 2 shows an enlarged structural view of a process cartridge Y of the printer and an intermediate transfer belt.

FIG. 2 is an enlarged structural view of the process cartridge 1Y among the four process cartridges 1Y, 1M, 1C and 1K, and an intermediate transfer belt 61 of the transfer unit (60 in FIG. 1). The process cartridge 1Y in FIG. 2 is detachably mounted as a single unit on the main unit of the printer by holding components such as the photoconductor 3Y, the charging brush roller 4Y, a charge eliminating lamp (not shown), and a developing device 40Y as a developing unit in a common unit cartridge (holding member).

The photoconductor 3Y, which is a member to be charged and a latent electrostatic image bearing member, is a drum having a diameter of about 24 mm where the surface of a conductive base made of an aluminum tube is covered with a photosensitive layer made of negatively charged organic photoconductor (OPC). The photoconductor 3Y is rotated clockwise in the figure at a predetermined linear velocity by a driving unit (not shown), whereby the surface of the photoconductor 3Y passes a primary transfer nip (the contact point with the intermediate transfer belt 61), a toner charging nip (the contact point with a conductive sheet 10Y), a charging nip (the contact point with a charging brush roller 4Y), an optical writing point, and a developing region in the order presented.

As a charging member a charging brush roller 4Y contains a metal rotating shaft member 5Y which is rotatably received by a bearing (not shown); and a plurality of conductive hair-like fibers 6Y are planted upright on the metal rotating shaft member. Then, while the charging brush roller 4Y is rotated counterclockwise in the figure with centering around the rotating shaft member 5Y by a driving unit (not shown), a tip of each of the hair-like fibers 6Y is rubbed to photoconductor 3Y. Charging bias of superimposed voltage (direct voltage superimposing on alternating voltage) is applied to the metal rotating shaft member 5Y to which a charging bias applying unit consisting of a power supply, wiring and the like (not shown) is connected. The discharge occurs between the hair-like fibers 6Y and the photoconductor 3Y at or around the charging nip in which a brush consisting of the plurality of hair-like fibers 6Y in a charging brush roller 4Y is in contact with the photoconductor 3Y, whereby the surface of the photoconductor 3Y is uniformly charged with negative polarity.

The surface of the photoconductor 3Y enters a toner charging nip which is the contact point with a conductive sheet 10Y, and then is uniformly charged by a charging nip. The conductive sheet 10Y serves as a charging function to charge again a toner remaining on the surface of the photoconductor after the toner transferred from the photoconductor in a next step. The sheet preferably has a nip width of 1 mm to 10 mm where the conductive sheet is in contact with the photoconductor in view of contact time on charging toner. The conductive sheet 10Y is cantilever supported, and while its free end is provided at a downstream side of the moving direction of the surface of the photoconductor 3Y relative to a fixed end, the free end is in contact with the photoconductor 3Y which is yet to be uniformly charged. The conductive sheet 10Y is applied with a charging bias of direct voltage by a toner charging bias applying unit consisting of a power supply, wiring and the like (not shown).

The printer mentioned herein contains a charging unit configured to uniformly charge the surface of the photoconductor 3Y by the charging brush roller 4Y, the driving unit to rotate the charging brush roller (not shown), the charging bias applying unit, the conductive sheet 10Y and the charging bias applying unit.

On the surface of the photoconductor 3Y uniformly charged at the charging nip, a latent electrostatic image for Y is formed by optical scanning with the optical writing unit 50 described above. The latent electrostatic image is developed into a Y toner image by using a developing unit 40Y for Y.

The developing unit 40Y for Y has a developing roller 42Y exposing part of its peripheral surface from the opening provided in a casing. As for the developing roller 42Y, the shafts projected from the both longitudinal ends of the roller are rotatably supported by bearings (not shown). The casing contains Y toner, and the toner is carried from the right side to the left side in the figure by an agitator 43Y as a toner carrying unit being rotated. On the left side of the agitator 43Y in the figure, a toner feeding roller 44Y is provided, which is rotated counterclockwise in the figure by a driving unit (not shown). The roller portion of the toner feeding roller 44Y is made of elastic foam such as sponge, and excellently traps the Y toner carried from the agitator 43Y. The trapped Y toner is fed to the developing roller 42Y at the contact point between the toner feeding roller 44Y and the developing roller 42Y. Then the Y toner held on the surface of the developing roller 42Y as a developer bearing member is subjected to the control of its layer thickness and the effect of frictional electrification on passing the contact point with a regulation blade 45Y, and then the Y toner is carried to the developing region facing with the photoconductor 3Y according to the counterclockwise rotation in the figure of the developing roller 42Y.

In the developing region, developing potential is effected between the developing roller 42Y to which negative developing bias produced from a power supply (not shown) is applied and the latent electrostatic image on the photoconductor 3Y so that negatively charged Y toner is electrostatically moved from the developing roller 42Y to the latent electrostatic image. Non-developing potential is also effected between the developing roller 42Y and the uniformly charged portion (base portion) on the photoconductor 3Y so that negatively charged Y toner is electrostatically moved from the base portion to the developing roller 42Y. The Y toner on the developing roller 42Y is separated from the developing roller 42Y and transferred to the latent electrostatic image on the photoconductor 3Y by the action of the developing potential. Thus, the latent electrostatic image on the photoconductor 3Y is developed into a Y toner image.

The printer mentioned herein uses a one component development method using a one component developer mainly containing the Y toner as a developer for the developing device 40Y.

But, a two component development method may also be used which uses a two component developer containing the Y toner and a magnetic carrier.

The Y toner image developed in the developing region is carried according to the rotation of the photoconductor 3Y to a primary transfer nip for Y where the photoconductor 3Y is in contact with the intermediate transfer belt 61, and intermediately transferred to the intermediate transfer belt 61. On the surface of the photoconductor 3Y which has passed the primary transfer nip, an untransferred toner, which has not been transferred to the intermediate transfer belt 61, adheres. The untransferred toner is collected in the developing unit by means of a system for collecting the untransferred toner described later.

The process cartridge 1Y for Y has been described so far. The process cartridges 1M, 1C and 1K for other colors have the same configurations as the process cartridge 1Y for Y and description for the cartridges is omitted.

In FIG. 1 mentioned above, under the respective color process cartridges 1Y, 1M, 1C and 1K, a transfer unit 60 is provided. The transfer unit 60 carries an endless intermediate transfer belt 61 counterclockwise in the figure endlessly with stretching the belt 61 by using a plurality of stretching rollers. The plurality of stretching rollers specifically refer to a driven roller 62, a driving roller 63, four primary transfer bias rollers 66Y, 66M, 66C and 66K, and the like.

All of the driven roller 62, the primary transfer bias rollers 66Y 66M, 66C and 66K, and the driving roller 63 are in contact with the back surface (loop inner surface) of the intermediate transfer belt 61. The four primary transfer bias rollers 66Y, 66M, 66C and 66K, are rollers where metal core bar is covered with an elastic body such as sponge. The rollers are pressed toward the photoconductors 3Y, 3M, 3C, and 3K for Y, M, C, and K respectively with interposing the intermediate transfer belt 61 between the rollers and the members. As a result, four primary transfer nips for Y, M, C, and K are formed where the four photoconductors 3Y, 3M, 3C, and 3K are in contact with the front surface of the intermediate transfer belt 61 over a predetermined length in the moving direction of the belt.

To each of the core bars of the four primary transfer bias rollers 66Y, 66M, 66C and 66K, primary transfer bias that is controlled to be constant current by transfer bias supply (not shown) is applied. As a result, transfer charge is imparted to the back surface of the intermediate transfer belt 61 via the four primary transfer bias rollers 66Y, 66M, 66C and 66K, forming transfer electric fields at the respective primary transfer nips between the intermediate transfer belt 61 and the photoconductors 3Y, 3M, 3C, and 3K. Note that the printer mentioned herein is equipped with the primary transfer bias rollers 66Y, 66M, 66C and 66K as primary transfer units, but a brush, a blade, or the like may be used instead of the rollers. A transfer charger may also be used.

Y, M, C and K toner images formed on the photoconductors 3Y, 3M, 3C, and 3K for respective colors are primarily transferred with superposing the images onto the intermediate transfer belt 61 at the primary transfer nips for respective colors. As a result, a four-color-superposed toner image (hereinafter, referred to as four-color toner image) is formed on the intermediate transfer belt 61.

At the position where the intermediate transfer belt 61 is stretched around the driving roller 63, a secondary transfer bias roller 67 is in contact with the front surface of the belt, forming a secondary transfer nip. To the secondary transfer bias roller 67, secondary transfer bias is applied by using a voltage applying unit consisting of a power supply, wiring and the like (not shown). As a result, a secondary transfer electric field is formed between the secondary transfer bias roller 67 and a grounded back side roller of secondary transfer nip (the driving roller 63). The four-color toner image formed on the intermediate transfer belt 61 enters the secondary transfer nip according to endless moving of the belt.

The printer mentioned herein is equipped with a paper cassette (not shown), which contains recording papers P as recording paper stack obtained by stacking a plurality of the papers. The topmost recording paper P is then fed to a paper feeding path at a predetermined timing. The fed recording paper P is caught in the resist nip of the resist roller pair 54 provided at the end of the paper feeding path.

Both of the rollers of the resist roller pair 54 are rotated to catch a recording paper P fed from the paper cassette in the resist nip. But, the rotation of the rollers is stopped as soon as the pair catches the tip of the recording paper P between the rollers. The recording paper P is then fed to the secondary transfer nip with a timing so that the paper is in synchronization with the four-color toner image on the intermediate transfer belt 61. At the secondary transfer nip, the four-color toner image on the intermediate transfer belt 61 is secondarily transferred collectively onto the recording paper P by the action of the secondary transfer electric field and nip pressure, providing a full-color image with the white of the recording paper P.

The recording paper P on which the full-color image is thus formed is ejected from the secondary transfer nip, and carried to a fixing unit (not shown) to fix the full-color image.

Untransferred toner after the secondary transfer adhering to the surface of the intermediate transfer belt 61 that has passed the secondary transfer nip is removed from the belt surface by using a belt cleaning device 68.

An output value from the power supply of the toner charging bias applying unit can be switched as follows: the power supply of the toner charging bias applying unit switches toner charging bias between a value of a discharge direct voltage which generates discharge between the conductive sheet 10Y and the photoconductor 3Y and a value of a non-discharge direct voltage which does not generate discharge therebetween. More specifically, the printer mentioned herein uses a photoconductor having electrostatic capacity of 110 [pF/cm$^2$] as the photoconductor 3Y. And then, a difference of potential of discharge initiation by Paschen's law between the conductive sheet 10Y and the photoconductor 3Y is ±610[V]. On the other hand, on the surface of the photoconductor 3Y in which a positive charge is slightly applied by the intermediate transfer belt at the primary transfer nip, a potential about 0 to −100[V] is remained. In such a structure, discharge can be generated between the conductive sheet 10Y and the photoconductor 3Y by applying a discharge direct voltage of −710 [V] or more (−710 or larger value than −710 in a negative side), or more than +610[V]. However, in the printer, a toner having a negative polarity as a normal polarity is used and an untransferred toner must be charged again to a negative polarity. Thus, the value of the discharge direct voltage of the toner charging bias is set at more than −−710[V]. The value of the non-discharge direct voltage is set at less than −610[V] (a value shifting to a positive side from −610V), which can certainly avoid discharge, even though a rest potential of photoconductor 3Y is 0[V] in the most positive side. A voltage which is applied to the conductive sheet is preferably −1.4 kV to 0 kV in terms of charging the toner.

When the non-discharge direct voltage is applied to the conductive sheet 10Y, discharge is not generated between the sheet and the photoconductor 3Y. At the toner charging nip, a negative polarity can be injected from the conductive sheet 10Y to the toner contacting the sheet. Then, degradation of image quality can be reduced by charging oppositely-charged (positively-charged) toners in the untransferred toners to a negative polarity of a normal polarity, and by sufficiently charging low charged (slightly negatively-charged) toners in the untransferred toners to a negative polarity of a normal polarity. At this time, because discharge is not generated between the conductive sheet 10Y and the photoconductor 3Y, the melted untransferred toners caused by discharge can be prevented from fixing to the conductive sheet 10Y, and longer operating life of the conductive sheet 10Y can be achieved.

On the other hand, the toner charging bias is switched from the non-discharge direct voltage to the discharge direct voltage so as to generate discharge between the conductive sheet 10Y and the photoconductor 3Y. Then, the positively-charged toner and low charged toner are sufficiently charged to a negative polarity so as to suppress degradation of image quality, and to preliminarily charge the photoconductor 3Y to some extent. Thus, discharge amount for uniformly charging the photoconductor 3Y to a certain potential at the charging nip between the charging brush roller 4Y and the photoconductor 3Y is reduced so as to achieve the longer operating life of the charging brush roller.

In the printer mentioned herein, the toner charging bias is switched between the discharge direct voltage and the non-discharge direct voltage so as to achieve longer operating life of both of the charging brush roller 4Y and conductive sheet 10Y before charging, thereby avoiding frequent replacement of either one of them. Therefore, maintenance property can be improved by approximating exchange frequency of the charging brush roller 4Y and conductive sheet 10Y.

The charging unit in the process cartridge 1Y for Y has been described so far. The process cartridges 1M, 1C and 1K for other colors have the same configurations as the process cartridge 1Y for Y and description for the process cartridges is omitted. FIG. 2 shows an enlarged structural view of a process cartridge 1Y for Y in the printer relating to the embodiment. The printer adopts so-called cleaner-less system. The cleaner-less system is a system of conducting an image formation process on a latent electrostatic image bearing member without using an extra unit for cleaning and collecting untransferred toner adhering to the latent electrostatic image bearing member such as the photoconductor 3Y. The extra unit for cleaning and collecting specifically refers to a unit with which untransferred toner is separated from the latent electrostatic image bearing member and the toner is then collected by carrying the toner to a waste toner container or the toner is collected for recycle by carrying the toner to a developing unit without adhering the toner again to the latent electrostatic image bearing member. The extra unit includes a cleaning blade for scraping untransferred toner away from the latent electrostatic image bearing member.

Such cleaner-less system is described in detail below. The cleaner-less system is broadly divided into scraping/passing type, temporarily trapping type, and combination type thereof. Of these, the scraping/passing type reduces the adhesion between untransferred toner and a latent electrostatic image bearing member by scraping the untransferred toner on the latent electrostatic image bearing member by using a scraping member such as a brush rubbing against the latent electrostatic image bearing member. After that, the untransferred toner on the latent electrostatic image bearing member is collected into a developing unit by electrostatically transferring the toner to a developing member such as a developing roller at immediately prior to a developing region or at the developing region where the developing member such as a developing sleeve or the developing roller and the latent electrostatic image bearing member face to each other. Before the untransferred toner is collected, the toner passes the optical writing point for writing a latent image, but relatively small amount of the untransferred toner does not have adverse impact on writing a latent image. Note that the untransferred toner containing oppositely charged toner which is charged with polarity opposite to the normal polarity causes problems such as background smear because the oppositely charged toner is not collected to the developing member. For the purpose of preventing such generation of background smear caused by the oppositely charged toner, a toner charging unit for charging the untransferred toner on the latent electrostatic image bearing member with the normal polarity is desirably provided at a position between a transfer position such as a primary transfer nip and scraping position by using the scraping member, or at a position between the scraping position and the developing region. The scraping member may include a stationary brush having a plurality of planted hair-like fibers that are conductive fibers bonded to a plate, a unit casing, or the like; a brush roller on which a plurality of hair-like fibers are planted upright on a metal rotating shaft member; and a roller member having a roller portion made of conductive sponge or the like. The stationary brush is advantageous because the brush can be formed with relatively small amount of planted hair-like fibers and inexpensive. But when the stationary brush is also used as a charging member for uniformly charging a latent electrostatic image bearing member, sufficient charging uniformity cannot be obtained. In contrast, use of the brush roller is preferable to obtain sufficient charging uniformity.

In the temporarily trapping type of the cleaner-less system, untransferred toner on the latent electrostatic image bearing member is temporarily trapped by using a trapping member such as a rotating brush member which is moved endlessly with keeping the surface of the brush to be in contact with the latent electrostatic image bearing member. Then the untransferred toner is collected into a developing unit by releasing the untransferred toner on the trapping member to transfer the toner again to the latent electrostatic image bearing member, and electrostatically transferring the toner to a developing member such as a developing roller after completion of print job or at idle timing between print jobs. When considerably large amount of untransferred toner is generated, for example, in forming a solid image or after jamming, use of the scraping/passing type can cause image degradation because the amount of the toner is beyond the collecting capacity of the developing member. In contrast, use of the temporarily trapping type can prevent such image degradation by gradually collecting untransferred toner trapped by a trapping member into the developing member.

The combination type in the cleaner-less system combines the scraping/passing type and the temporarily trapping type. Specifically, a rotating brush member or the like in contact with the latent electrostatic image bearing member is used as both the scraping member and the trapping member. The rotating brush member or the like is used as the scraping member by applying only direct voltage to the brush member or the like while the rotating brush member or the like is used as the trapping member as required by changing the bias from the direct voltage to superimposed voltage.

In this embodiment, the printer employs the temporarily trapping type cleaner-less system. Specifically, the photoconductor 3Y is rotated clockwise in the figure at a predetermined linear velocity with being in contact with the front surface of the intermediate transfer belt 61 to form a primary transfer nip for Y. Then the surface of the photoconductor 3Y is uniformly charged with negative polarity by generating discharge between the hair-like fibers 6Y and photoconductor 3Y. At the same time, the untransferred toner on the photoconductor 3Y is temporarily trapped by the effect of the above-described charging bias so as to transfer on the plurality of the hair-like fibers 6Y. Then the untransferred toner is collected into a developing unit 40Y by transferring the untransferred toner trapped on the hair-like fibers 6Y again to the photoconductor 3Y, and electrostatically transferring the toner to a developing roller 42Y by switching the charging bias from the superimposed voltage to direct voltage after completion of print job or at idle timing between print jobs.

EXAMPLES

The present invention will be further described by the following Examples, but the present invention is not limited thereto. Hereinafter, "parts" indicates "parts by mass" unless indicated otherwise.

Example 1

In a four-neck vessel, 340 parts of ion-exchanged water and 380 parts of a 0.1 mol/l aqueous $Na_3PO_4$ solution were poured, and kept at 60° C. while stirring at 15,000 rpm by a homomixer, high speed stirrer. Subsequently, 30 parts of a 1.0 mol/l aqueous $CaCl_2$ solution was gradually added to prepare an aqueous dispersion medium containing a poor water-soluble, fine dispersion stabilizing agent $Ca_3(PO_4)_2$.

A mixture consisting of the dispersing substances described below was dispersed by Attriter (manufactured by MITSUI MINING & SMELTING CO., LTD.) for 3 hours, and then 3 parts of 2,2'-azobis(2,4-dimethylvaleronitrile) was added to prepare a polymerizable monomer composition. The dispersing substances were as follows:

| | |
|---|---|
| styrene | 83 parts |
| n-butylacrylate | 17 parts |
| copper phthalocyanine pigment | 5 parts |
| CLAYTONE APA | 2 parts |
| zinc salicylate E-304 (manufactured by Orient Chemical Industries, Ltd.) | 0.8 parts |
| paraffin wax (melting point: 73° C.) | 5 parts |
| polyester resin (Mw = 25,000, acid value: 15 mgKOH/g) | 5 parts |

The polymerizable monomer composition was loaded into the aqueous dispersion medium and stirred at 60° C. under nitrogen atmosphere for 4 minutes using a high speed stirrer which was kept at 15,000 rpm for granulation. Subsequently, the stirrer was changed to one equipped with paddle type stirrer blades, the granulated polymerizable monomer composition was kept at 60° C. while stirring at 200 rpm to be polymerized for 5 hours.

Subsequently, the polymerized monomer composition was raised to 80° C. to be further polymerized, and cooled and then a dilute hydrochloric acid was added therein so that the aqueous dispersion medium had pH of 1.2 to dissolve a poor water-soluble dispersant. Solid-liquid separation was further carried out by filtration under pressure, the solid formed was washed with 18,000 parts of water, and then sufficiently dried using a vacuum drier to obtain toner base particles having an average circularity of 0.976, a volume average particle diameter (Dv) of 6.8 μm and a number average particle diameter (Dn) of 6.2 μm.

Next, 0.5 parts of hydrophobic silica and 0.5 parts of a hydrophobized titanium oxide were mixed in 100 parts of the toner base particles by a HENSCHEL mixer to obtain Toner 1 of the present invention.

The circularity and particle diameter of the toner were measured by the following method:

The proportion of particles of 2 μm or less in diameter, the circularity and the average circularity of the toner of the present invention could be measured on a flow type particle image analyzer FPIA-2000 (from Toa Medical Electronics Co. Ltd.). In the specific measurement method, 0.1 mL to 0.5 mL of a surfactant as a dispersant, preferably an alkylbenzene sulfonate salt was added to 100 mL to 150 mL of water from which impurities had been previously removed in a vessel, and 0.1 g to 0.5 g of a sample to be measured was further added thereto. A suspension in which the sample had been dispersed was treated to disperse using an ultrasonic dispersing machine for about 1 to 3 minutes to make a dispersion concentration of 3,000/μL to 10,000/μL, and the shape and the distribution of the toner were measured using the aforementioned apparatus.

The volume average particle diameter and particle size distribution of the toner were measured by Coulter counter method. Examples of instruments for measuring the particle size distribution of the toner particles include COULTER COUNTER TA-II and Coulter multisizer II (manufactured by Beckman Coulter, Inc.). In the present invention, the measurement was performed by using COULTER COUNTER TA-II and connecting an interface (The Institute of Japanese Union of Scientists & Engineers) which outputs the number distribution and the volume distribution, and a PC9801 personal computer (manufactured by NEC).

The measuring method is illustrated as follows:

First, 0.1 ml to 5 ml of a surfactant (preferably, alkylbenzene sulfonate) was added to 100 ml to 150 ml of electrolytic solution as a dispersant. The electrolytic solution was approximately a 1 mass % aqueous NaCl solution prepared using primary sodium chloride, for example, ISOTON-II manufactured by Beckman Coulter, Inc. 2 mg to 20 mg of the measurement sample was further added. The electrolytic solution in which the sample was suspended was subject to dispersion treatment for approximately 1 minute to 3 minutes using an ultrasonic disperser and the volume and number of the toner particles or toner were measured by means of the measuring equipment, employing an aperture of 100 μm to calculate volume and number distributions.

As channels, 13 channels were used: 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; 32.00 μm to less than 40.30 μm. The particles having a particle diameter of 2.00 μm to less than 40.30 μm were surveyed. According to the present invention, a volume average particle diameter (Dv) on a volume basis obtained by the volume distribution, a number average particle diameter (Dn) obtained by number distribution and a ratio of Dv to Dn (Dv/Dn) were obtained.

Example 2

Toner base particles 2 were produced in the same manner as in Example 1, except that the amount of CLAYTONE APA was changed from 2.0 parts to 1.0 part, and then Toner 2 was produced.

Example 3

Toner base particles 3 were produced in the same manner as in Example 1, except that the amount of CLAYTONE APA was changed from 2.0 parts to 0.15 parts, and then Toner 3 was produced.

Example 4

Toner base particles 4 were produced in the same manner as in Example 1, except that the amount of CLAYTONE APA was changed from 2.0 parts to 4.0 parts, and then Toner 4 was produced.

Example 5

Toner base particles 5 were produced in the same manner as in Example 1, except that CLAYTONE APA was changed to CLAYTONE HY (manufactured by Southern Clay Products, Inc.) (a bis(hydrogenated tallow alkyl)dimethyl quaternary ammonium salt with bentonite), and then Toner 5 was produced.

Example 6

Toner base particles 6 were produced in the same manner as in Example 1, except that CLAYTONE APA was changed to Claytone AF (manufactured by Southern Clay Products, Inc.), and then Toner 6 was produced.

Example 7

Ten grams (10 g) of hydrotalcite (PURAL MG 61 HT, by Sasol) was loaded in 100 ml of deionized water and stirred at 80° C. for 1 hour so as to be dispersed.

Next, 1.5 g of sebacic acid was dissolved in 100 ml of deionized water, and then 2N of an aqueous solution of sodium hydroxide was added and prepared to have pH of 8. This solution was added to the hydrotalcite dispersion and stirred at 70° C. for 6 hours. Subsequently, the dispersion was filtrated and washed with 1,000 ml of deionized water, dried at 60° C. to 80° C. in a vacuum to obtain a hydrotalcite modified with the sebacic acid.

Toner base particles 7 were produced in the same manner as in Example 1, except that CLAYTONE APA was changed to the organically modified hydrotalcite, and then Toner 7 was produced.

Example 8

In a reaction chamber equipped with a cooling tube, a stirrer and a nitrogen inlet, 83 parts of styrene, 17 parts of n-butyl acrylate and 2 parts of 2,2'-azobis(2,4-dimethylvaleronitrile) were loaded and purged with nitrogen gas, and heated to 70° C. over 30 minutes while stirring, and then 20 minutes later cooled to 24° C. over 30 minutes. Next, the mixture was loaded in Attriter (manufactured by MITSUI MINING & SMELTING CO., LTD.) and 0.1 parts of divinylbenzene, 5 parts of a copper phthalocyanine pigment, 2 parts of CLAYTONE APA, 0.8 parts of zinc salicylate E-304 (manufactured by Orient Chemical Industries, Ltd.) and 5 parts of paraffin wax (melting point: 73° C.) were added and dispersed for 3 hours, and then 2 parts of 2,2'-azobis (2,4-dimethylvaleronitrile) was added to prepare a polymerizable monomer composition.

On the other hand, 340 parts of ion-exchanged water and 380 parts of a 0.1 mol/l aqueous $Na_3PO_4$ solution were poured into a four-neck vessel, and kept at 60° C. while stirring at 15,000 rpm by a homomixer, high speed stirrer. Subsequently, 30 parts of a 1.0 mol/l aqueous $CaCl_2$ solution was gradually added to prepare an aqueous dispersion medium containing a poor water-soluble, fine dispersion stabilizing agent $Ca_3(PO_4)_2$.

The polymerizable monomer composition was loaded into the aqueous dispersion medium and stirred at 60° C. under nitrogen atmosphere for 4 minutes using the high speed stirrer which was kept at 15,000 rpm for granulation. Subsequently, the stirrer was changed to one equipped with paddle type stirrer blades, the granulated polymerizable monomer composition was kept at 60° C. while stirring at 200 rpm to be polymerized for 4 hours.

Subsequently, the polymerized monomer composition was raised to 80° C. to be further polymerized, and then cooled and a dilute hydrochloric acid was added so that the aqueous dispersion medium had pH of 1.2 to dissolve a poor water-soluble dispersant. Solid-liquid separation was further carried out by filtration under pressure, the solid formed was washed with 18,000 parts of water, and then sufficiently dried using a vacuum drier to obtain toner base particles having an average circularity of 0.977, a volume average particle diameter (Dv) of 6.7 μm and a number average particle diameter (Dn) of 6.1 μm.

Next, 0.5 parts of hydrophobic silica and 0.5 parts of hydrophobized titanium oxide were mixed in 100 parts of the toner base particles by a HENSCHEL mixer to obtain Toner 8 of the present invention.

Example 9

In a four-neck vessel, 340 parts of ion-exchanged water and 380 parts of a 0.1 mol/l aqueous $Na_3PO_4$ solution were poured, and kept at 60° C. while stirring at 15,000 rpm by a homomixer, high speed stirrer. Subsequently, 30 parts of a 0.1 mol/l aqueous $CaCl_2$ solution was gradually added to prepare an aqueous dispersion medium containing a poor water-soluble, fine dispersion stabilizing agent $Ca_3(PO_4)_2$.

A mixture consisting of the dispersing substances described below was dispersed by Attriter (manufactured by MITSUI MINING & SMELTING CO., LTD.) for 5 hours, and then 3 parts of 2,2'-azobis (2,4-dimethylvaleronitrile) was added to prepare a polymerizable monomer composition. The dispersing substances were as follows:

| | |
|---|---|
| styrene | 83 parts |
| n-butylacrylate | 17 parts |
| divinylbenzene | 0.1 parts |
| copper phthalocyanine pigment | 5 parts |
| CLAYTONE APA | 2 parts |
| zinc salicylate E-304 (manufactured by Orient Chemical Industries, Ltd.) | 0.8 parts |
| paraffin wax (melting point: 73° C.) | 5 parts |

The polymerizable monomer composition was loaded into the aqueous dispersion medium and stirred at 60° C. under nitrogen atmosphere for 4 minutes using a high speed stirrer which was kept at 15,000 rpm for granulation. Subsequently, the stirrer was changed to one equipped with paddle type stirrer blades, the granulated polymerizable monomer composition was kept at 60° C. while stirring at 200 rpm to be polymerized for 5 hours.

Subsequently, the polymerized monomer composition was raised to 80° C. to be further polymerized, and cooled and then a dilute hydrochloric acid was added therein so that the aqueous dispersion medium had pH of 1.2 to dissolve a poor water-soluble dispersant. Solid-liquid separation was further carried out by filtration under pressure, the solid formed was washed with 18,000 parts of water, and then, sufficiently dried using a vacuum drier to obtain toner base particles having an average circularity of 0.975, a volume average particle diameter (Dv) of 6.9 μm and a number average particle diameter (Dn) of 6.2 μm.

Next, 0.5 parts of hydrophobic silica and 0.5 parts of a hydrophobized titanium oxide were mixed in 100 parts of the toner base particles by a HENSCHEL Mixer to obtain Toner 9 of the present invention.

Comparative Example 1

Toner base particles 101 were produced in the same manner as in Example 1, except that CLAYTONE APA was not added, and then Toner 101 was produced.

Comparative Example 2

In a four-neck vessel, 340 parts of ion-exchanged water and 380 parts of a 0.1 mol/l aqueous $Na_3PO_4$ solution were poured, and kept at 60° C. while stirring at 15,000 rpm by a homomixer, high speed stirrer. Subsequently, 30 parts of a 0.1 mol/l aqueous $CaCl_2$ solution was gradually added to prepare an aqueous dispersion medium containing a poor water-soluble, fine dispersion stabilizing agent $Ca_3(PO_4)_2$.

A mixture consisting of the dispersing substances described below was dispersed by Attriter (manufactured by MITSUI MINING & SMELTING CO., LTD.) for 3 hours, and then 3 parts of 2,2'-azobis (2,4-dimethylvaleronitrile) was added to prepare a polymerizable monomer composition. The dispersing substances were as follows:

| | |
|---|---|
| styrene | 83 parts |
| n-butylacrylate | 17 parts |
| copper phthalocyanine pigment | 5 parts |
| divinylbenzene | 0.5 parts |
| zinc salicylate E-304 (manufactured by Orient Chemical Industries, Ltd.) | 0.8 parts |
| paraffin wax (melting point: 73° C.) | 5 parts |
| polyester resin (Mw = 25,000, acid value: 15 mgKOH/g) | 5 parts |

The polymerizable monomer composition was loaded into the aqueous dispersion medium and stirred at 60° C. under nitrogen atmosphere for 4 minutes using a high speed stirrer which was kept at 15,000 rpm for granulation. Subsequently, the stirrer was changed to one equipped with paddle type stirrer blades, the granulated polymerizable monomer composition was kept at 60° C. while stirring at 200 rpm to be polymerized for 5 hours.

Subsequently, the polymerized monomer composition was raised to 80° C. to be further polymerized, and cooled and then dilute hydrochloric acid was added therein so that the aqueous dispersion medium had pH of 1.2 to dissolve a poor water-soluble dispersant. Solid-liquid separation was further carried out by filtration under pressure, the solid formed was washed with 18,000 parts of water, and then sufficiently dried using a vacuum drier to obtain toner base particles 102 having an average circularity of 0.976, a volume average particle diameter (Dv) of 6.8 μm and a number average particle diameter (Dn) of 6.2 μm.

Next, 0.5 parts of hydrophobic silica and 0.5 parts of a hydrophobized titanium oxide were mixed in 100 parts of the toner base particles by a HENSCHEL mixer to obtain Toner 102 of the Comparative Example.

Comparative Example 3

Toner base particles 103 were produced in the same manner as in Example 1, except that the CLAYTONE APA was changed to 10 parts of organosilicasol (MEK-ST-UP, solid content concentration 20%, by Nissan Chemical Industries, Ltd.), and then Toner 103 was produced.

Comparative Example 4

Toner base particles 104 were produced in the same manner as in Example 1, except that the CLAYTONE APA used as a charge control agent was changed to an unmodified layered inorganic mineral montmorillonite (trade name: Kunipia manufactured by KUNIMINE INDUSTRIES CO., LTD.), and then Toner 104 was produced.

Comparative Example 5

Toner base particles 105 were produced in the same manner as in Example 1, except that the CLAYTONE APA used as a charge control agent was changed to an unmodified layered inorganic mineral hydrotalcite (DHT-4A manufactured by Kyowa Chemical Industry Co., Ltd.), and then Toner 105 was produced.

<Evaluation Method>

(Cleaner-Less Applicability test: Resistance Against Toner Adhesion to a Conductive Sheet)

A system without a cleaner for a latent electrostatic image bearing member having the same configuration as the embodiment shown in FIG. 2 was prepared by replacing a charging roller of IPSiO CX3000 manufactured by Ricoh Company, Ltd. with a brush roller 5, replacing a cleaning blade for a latent electrostatic image bearing member with a conductive sheet so that the sheet is in contact with the surface of the latent electrostatic image bearing member 1.

A predetermined print pattern with a B/W ratio of 7% was continuously printed on 100 sheets in monochrome mode under N/N conditions (23° C., 45%), and then the conductive sheet was observed and evaluated. The evaluation criteria were as follows:

A: No fixation.

B: A slight amount of fixation could be easily removed with a finger.

C: Fixation could not be removed with a finger.

(Fixing Property)

A two-component developer, produced by mixing and stirring 5 parts of the toner and 95 parts of a silicone resin-coated carrier, was loaded into a modified apparatus in which a fixing device of IPSiO CX7500 by Ricoh Company, Ltd. was removed. The modified apparatus was adjusted so that a toner was developed to be a solid image of 1.1±0.1 mg/cm$^2$ in a longitudinal direction on a transfer paper (type 6200, a short grain paper by Ricoh Company, Ltd.) having top margin of 100 mm, and then a transfer paper having an unfixed image was printed.

By using a modified fixing test device in which a fixing part of IPSiO CX2500 by Ricoh Company, Ltd. was removed, the temperature of a fixing belt and a linear velocity of a belt were set to be desired values, toner was fixed to a transfer paper by setting the linear velocity of the belt to 125 mm/sec, and a temperature of a fixing belt to 140° C. By using a drawing tester AD-401 by Ueshima Seisakusho Co., Ltd., a sapphire needle of 125 μR was traveled on an image to be evaluated in a condition of a rotation diameter of a needle of 8 mm and a load of 1 g. And then, a surface where the apex of the sapphire needle was traveled was visually observed to evaluate a scratch (traveling trace) by the following criteria.

A: No trace (line) was observed.

B: A trace (line) could be slightly observed.

C: A trace (line) could be clearly observed.

(Observation of the State of Layered Inorganic Mineral in Toner)

Toner bases were embedded with a two component epoxy resin, and then cut out into an ultrathin section of about 100 μm using a cryomicrotome. The cross section of toner was observed on the ultrathin section at a magnification of ×25,000 with a transmission electron microscope (TEM). 20 pictures of the cross section of the toner having the major axis of 0.9 to 1.2 times the size of a volume-average particle diameter were taken, and the images of these pictures (20 toners) were evaluated, thereby observed the state of the layered inorganic mineral in the toner.

The TEM image of the toner, in which an organically modified layered inorganic mineral was not exposed on the surface but localized near the surface, was observed and found that the layered inorganic mineral was localized uniformly along the toner surface. Moreover, inorganic molecules constituting the layered inorganic mineral could be observed at a magnification enlarged to ×100,000.

In addition, the percentage of the area of the layered inorganic mineral was obtained by an arithmetic mean value of 20 toner particles.

When the inorganic particles were preliminarily externally added to the toner, a toner base was obtained by the following method: 2 g of a toner was dispersed in 50 ml of an aqueous solution of 0.2% polyoxyethylphenylether in a 100 ml beaker, and then while the beaker was cooled with ice water, ultrasonic energy was applied to the toner for 10 minutes by adjusting an ammeter indicating an indicated value of oscillation equipped with an main device to show 60 μA (50 W) using an ultrasonic homogenizer US-1200T (by Nippon Seiki Co., Ltd, specified frequency of 15 kHz), thereby separated the external additive from the toner surface. A dispersion in which the external additive was separated from the toner base was transferred to a centrifuge tube, and the toner base was precipitated by a centrifugal separator and then a supernatant liquid was removed. Subsequently, an aqueous solution of 0.2% polyoxyethylphenylether was added in the same amount of the supernatant liquid so as to disperse the toner base, and the toner base was precipitated by the centrifugal separator, thereby removed a supernatant liquid. Finally, the toner base was dispersed with ion-exchanged water, and suction filtrated, and dried in a constant-temperature chamber at 35° C. to obtain a toner base in which the external additive was removed.

All of the test results are shown in Table 1.

TABLE 1

| | Layered inorganic material | | Toner | Evaluation | | |
|---|---|---|---|---|---|---|
| | Type | mass % | Tg (° C.) | Fixing resistance | Fixing property | (*1) |
| Example 1 | CLAYTONE APA | 1.7 | 62 | A | A | 72 |
| Example 2 | CLAYTONE APA | 0.8 | 63 | A | A | 67 |
| Example 3 | CLAYTONE APA | 0.1 | 63 | B | A | 52 |
| Example 4 | CLAYTONE APA | 3.3 | 63 | A | B | 81 |
| Example 5 | CLAYTONE HY | 1.7 | 62 | A | A | 70 |
| Example 6 | CLAYTONE AF | 1.7 | 63 | A | A | 75 |

TABLE 1-continued

| | Layered inorganic material | | Toner | Evaluation | | |
|---|---|---|---|---|---|---|
| | Type | mass % | Tg (° C.) | Fixing resistance | Fixing property | (*1) |
| Example 7 | Organically modified hydrotalcite | 1.7 | 62 | A | A | 76 |
| Example 8 | CLAYTONE APA | 1.7 | 64 | A | A | 77 |
| Example 9 | CLAYTONE APA | 1.7 | 63 | B | A | 55 |
| Comparative Example 1 | — | 0.0 | 64 | C | A | 0 |
| Comparative Example 2 | — | 0.0 | 62 | A | C | 0 |
| Comparative Example 3 | MEK-ST-UP | 1.7 | 62 | C | A | 0 |
| Comparative Example 4 | Kunipia | 1.7 | 63 | C | A | 5 |
| Comparative Example 5 | DHT-4A | 1.7 | 62 | C | A | 4 |

(*1): the percentage of area that the layered inorganic mineral makes up a region within 50 nm from the perimeter of toner in the TEM image.

What is claimed is:

1. A toner for developing a latent electrostatic image, wherein said toner has a glass transition temperature of 40° C. to 70° C. and is produced by suspension polymerizing a polymerizable monomer composition in an aqueous dispersion medium, wherein the polymerizable monomer composition in the aqueous dispersion has a viscosity of 100 cP·s to 3,000 cP·s, wherein the polymerizable monomer composition comprises:

a polymerizable monomer selected from the group consisting of styrenes, acrylates, and mixtures thereof;

a colorant; and a layered inorganic mineral in which at least a part of an interlayer ion is replaced with an organic ion, wherein the percentage area that the layered inorganic mineral makes up in a region within 50 nm from the perimeter of the toner is 52% to 81% as determined by transmission electron microscope observation of a cross section of the toner, said percentage area being an arithmetic mean value of 20 toner particles;

wherein the layered inorganic mineral is at least one member selected from the group consisting of bis(hydrogenated tallow alkyl)dimethyl quaternary ammonium salts with bentonite, benzyl(hydrogenated tallow alkyl)dimethyl quaternary ammonium salts of bentonite, and a hydrotalcite modified with sebacic acid, and wherein the amount of the layered inorganic mineral contained in the toner is 0.1% by mass to 3.3% by mass relative to a total mass of the toner.

2. The toner for developing a latent electrostatic image according to claim 1, wherein the percentage area that the layered inorganic mineral makes up in a region within 50 nm from the perimeter of the toner is 55-77% as determined by transmission electron microscope observation of a cross section of the toner, said percentage area being an arithmetic mean value of 20 toner particles.

3. The toner for developing a latent electrostatic image according to claim 1, wherein the polymerizable monomer composition further comprises a resin dissolved therein.

4. The toner for developing a latent electrostatic image according to claim 1, wherein after the polymerizable monomer is partly polymerized, the layered inorganic mineral is dispersed in the polymerizable monomer composition.

5. A process cartridge comprising:

a developing unit which comprises:

a toner;

a toner carrying unit configured to carry the toner by its rotation; and a toner feeding unit configured to feed the toner to the toner carrying unit, wherein the toner has a glass transition temperature of 40° C. to 70° C. and is produced by suspension polymerizing a polymerizable monomer composition in an aqueous dispersion medium, wherein the polymerizable monomer composition in the aqueous dispersion has a viscosity of 100 cP·s to 3,000 cP·s, wherein the polymerizable monomer composition comprises:

a polymerizable monomer selected from the group consisting of styrenes, acrylates, and mixtures thereof;

a colorant; and a layered inorganic mineral in which at least a part of an interlayer ion is replaced with an organic ion, wherein the percentage area that the layered inorganic mineral makes up in a region within 50 nm from the perimeter of the toner is 52% to 81% as determined by transmission electron microscope observation of a cross section of the toner, said percentage area being an arithmetic mean value of 20 toner particles;

wherein the layered inorganic mineral is at least one member selected from the group consisting of bis(hydrogenated tallow alkyl)dimethyl quaternary ammonium salts with bentonite, benzyl(hydrogenated tallow alkyl)dimethyl quaternary ammonium salts of bentonite, and a hydrotalcite modified with sebacic acid, and wherein the amount of the layered inorganic mineral contained in the toner is 0.1% by mass to 3.3% by mass relative to a total mass of the toner.

6. The process cartridge according to claim 5, wherein the polymerizable monomer composition further comprises a resin dissolved therein.

7. The process cartridge according to claim 5, wherein after the polymerizable monomer is partly polymerized, the layered inorganic mineral is dispersed in the polymerizable monomer composition.

* * * * *